US005652203A

United States Patent [19]

Asamori et al.

[11] Patent Number: 5,652,203

[45] Date of Patent: Jul. 29, 1997

[54] PROCESS OF OVERBASING A SALICYLIC ESTER AND PRODUCT THEREOF

[75] Inventors: Katsuhiko Asamori; Shuichi Inaya, both of Wakayama, Japan

[73] Assignee: Kao Corporation, Tokyo, Japan

[21] Appl. No.: 545,106

[22] Filed: Oct. 19, 1995

Related U.S. Application Data

[63] Continuation of Ser. No. 115,654, Sep. 3, 1993, abandoned.

[30] Foreign Application Priority Data

Sep. 10, 1992 [JP] Japan ..... 4-241854

[51] Int. Cl.[6] ..... C10M 159/22

[52] U.S. Cl. ..... 508/460

[58] Field of Search ..... 252/18, 37.7, 39; 508/460

[56] References Cited

U.S. PATENT DOCUMENTS

| | | | |
|---|---|---|---|
| 2,490,444 | 12/1949 | Kooijman et al. . | |
| 2,510,937 | 6/1950 | Tadema . | |
| 3,711,407 | 1/1973 | Plumstead | 252/18 |
| 4,283,294 | 8/1981 | Clarke | 252/42.7 |
| 4,627,928 | 12/1986 | Karn | 252/18 |
| 4,810,398 | 3/1989 | Van Kruchten et al. | 508/460 |
| 4,876,020 | 10/1989 | Zon et al. | 508/460 |
| 5,173,203 | 12/1992 | Nichols et al. | 252/18 |
| 5,225,588 | 7/1993 | Senaratne et al. | 560/71 |
| 5,415,792 | 5/1995 | Campbell | 508/460 |
| 5,434,293 | 7/1995 | Campbell | 560/71 |

FOREIGN PATENT DOCUMENTS 1146925 3/1969 United Kingdom .

*Primary Examiner*—Jerry D. Johnson

*Attorney, Agent, or Firm*—Oblon, Spivak, McClelland, Maier & Neustadt, P.C.

[57] ABSTRACT

A process for the preparation of a lubricating oil additive composition is described were an aromatic carboxylic ester is subjected to ring alkylation with an olefin, reacted with the oxide or hydroxide or an alcoholate of a divalent metal and carbon dioxide with the removal of formed water and/or an alcohol from the reaction mixture. A lubricating oil additive composition obtained by the process, and a lubricating oil composition containing the same is also described. The lubricating oil additive provides excellent oxidation stability, low susceptibility to carbonization and cleanability as compared with the conventional, commercially-available additives.

18 Claims, No Drawings

PROCESS OF OVERBASING A SALICYLIC ESTER AND PRODUCT THEREOF

This application is a continuation of application Ser. No. 08/115,654, filed on Sep. 3, 1993, now abandoned.

BACKGROUND OF THE INVENTION

1. Field of the Invention

The present invention relates to a lubricating oil additive composition which provides excellent oxidation stability, low susceptibility to carbonization and high cleanability. The invention further relates to a process for preparing a lubricating oil additive composition, and a lubricating oil containing the additive.

2. Description of the Background Art

Engine oils are generally mixed with additives for dispersing sludge and the like in order to keep the interior of the engine clean and to neutralize acidic substances produced during the combustion of fuel. Such additives generally prevent corrosive wear.

Salicylates have heretofore been prepared by alkylating phenol with an alpha-olefin, converting the resulting alkylphenol into an alkali metal salt thereof, reacting carbon dioxide with the alkali metal salt to provide an alkali metal salt of alkylsalicylic acid, decomposing the resultant salt with a mineral acid such as sulfuric acid to remove the alkali metal or metathesizing the salt with the chloride of a divalent metal and then adding the oxide and/or the hydroxide of a divalent metal to react with carbon dioxide.

However, this process involves a significant drawback in that the alkali metal used in the reaction can not be completely removed. Consequently, the performance of the salicylate as an oil additive is deteriorated because the alkali metal salt of the alkylsalicylic acid is oil-soluble and hence fails to come into sufficient contact with the mineral acid or the chloride of the divalent metal, which is water-soluble. Further, water containing alkali metal salts can not be fully removed from the reaction product.

On the other hand, Japanese patent application Laid-Open No. 127396/1985 discloses a process for the preparation of a salicylate which does not use alkali metal in which an alkaline earth metal is added to phenol, and the addition product is treated with carbon dioxide. However, this process involves significant drawbacks in that a major amount of phenol remains unreacted due to its low rate of reaction, and phenol removal by distillation is difficult, particularly in an industrial setting.

SUMMARY OF THE INVENTION

It is therefore an object of the present invention to provide a process free of the above-described drawbacks which provides an excellent lubricating oil additive with industrial advantage.

In view of the foregoing circumstances, the present inventors have discovered that when an alkyl-ring-substituted aromatic carboxylic ester obtained by subjecting an aromatic carboxylic ester to ring alkylation is used as a starting material, and an oxide, hydroxide or alcoholate of a divalent metal, and carbon dioxide are reacted with this ester for overbasing, an excellent lubricating oil additive can be obtained without the above-described drawbacks.

In one aspect of the present invention, there is provided a lubricating oil additive composition obtained by (1) subjecting an aromatic carboxylic ester to ring alkylation with an olefin, (2) reacting at least one of an oxide, hydroxide or alcoholate of a divalent metal, and carbon dioxide with the resulting alkyl-ring-substituted aromatic carboxylic ester, and (3) removing water and/or alcohol formed during reaction or added thereto from the reaction mixture.

In another aspect of the present invention, there is provided a process for the preparation of a lubricating oil additive composition, which comprises (1) subjecting an aromatic carboxylic ester to ring alkylation with an olefin, (2) reacting at least one of an oxide, hydroxide or alcoholate of a divalent metal, and carbon dioxide with the resulting alkyl-ring-substituted aromatic carboxylic ester, and (3) removing water and/or alcohol formed during reaction or added thereto from the reaction mixture.

In a further aspect of the present invention, there is provided a lubricating oil composition comprising a lubricating base oil, said base oil comprising a natural and/or synthetic oil, and a lubricating oil additive composition obtained by (1) subjecting an aromatic carboxylic ester to ring alkylation with an olefin, (2) reacting at least one of an oxide, hydroxide or alcoholate of a divalent metal, and carbon dioxide with the resulting alkyl-ring-substituted aromatic carboxylic ester, and (3) removing water and/or alcohol formed during reaction or added thereto from the reaction mixture.

According to the present invention, a lubricating oil additive which is high in base number is provided with industrial advantage. The lubricating oil additive of the invention provides excellent performance with regard to oxidation stability, susceptibility to carbonization and cleanability as compared with the conventional, commercially-available additives.

DETAILED DESCRIPTION OF THE PREFERRED EMBODIMENTS

The ring alkylation reaction (1) of the present invention may be accomplished by any known method. Preferably, an olefin is converted into a carbonium cation with an acid catalyst and, when reacted with an aromatic carboxylic ester, it adds to a ring carbon atom which is high in electron density. U.S. Pat. No. 2,510,937 and G.B. Patent No. 1,146,925, both incorporated herein by reference, disclose ring alkylation reactions. According to these reaction schemes, however, highly corrosive antimony chloride or BF3 must be used in great amounts, and the electron density of the ring is lowered by electron attractive substituents such as a carboxyl groups. Accordingly, the reaction does not proceed well, resulting in insufficient yield. In the present invention, an aromatic carboxylic ester is used as the starting material for ring alkylation. Thus, the electron attractive property of the carboxyl group is lowered, and the alkylation reaction proceeds easily, resulting in improved yield.

Examples of the aromatic carboxylic ester useful in the ring alkylation reaction (1) include those obtained by esterifying hydroxy or alkyl-substituted, or unsubstituted, $C_6$–$C_{20}$ aromatic mono-carboxylic acids and $C_1$–$C_{20}$ linear or branched alcohols by any method known per se in the art. Specific examples of the aromatic carboxylic acid used herein include benzoic acid; salicylic acid; 4-hydroxybenzoic acid; alkylbenzoic acids such as ortho-, meta- and para-toluic acids and ortho-, meta- and para-ethylbenzoic acids; dialkylbenzoic acids such as 2,3-dimethylbenzoic acid, 2,4-dimethylbenzoic acid, 3,4-dimethylbenzoic acid, 3,5-dimethylbenzoic acid, 2,5-dimethylbenzoic acid and 2,6-dimethylbenzoic acid; dihydroxybenzoic acids such as 2,3-dihydroxybenzoic acid, 2,4-dihydroxybenzoic acid, 2,5-dihydroxybenzoic acid, 2,6-dihydroxybenzoic acid, 3,4-dihydroxybenzoic acid and 3,5-dihydroxybenzoic acid; naphthenocarboxylic acids such as alpha-naphthoic acid, beta-naphthoic acid, 2-hydroxy-alpha-naphthoic acid and 1-hydroxy-beta-naphthoic acid; and the like. Of these, salicylic acid is particularly preferred. Mixtures may be used.

Several of these carboxylic acids are commercially available products. They may, however, be prepared by the following processes.

For example, hydroxybenzoic acid is prepared by using phenol as a starting material, converting it into an alkali metal salt and then reacting carbon dioxide with the salt. Thereafter, the alkali metal is removed by decomposition with an acid. At this time, the alkali metal salt of the hydroxybenzoic acid, which has been dissolved in a water phase, is deposited as a free acid. Therefore, the alkali metal is substantially completely removed. Even when an alkali metal is used in the preparation of the aromatic carboxylic acid, it can be substantially completely removed. With respect to other aromatic carboxylic acids, for example, a toluic acid may be obtained by the oxidation of its corresponding xylene in a form substantially free of any alkali metal.

Examples of the alcohol used in the esterification reaction include methanol, ethanol, propanol, butanol, pentanol, hexanol, heptanol, octanol, nonanol, decanol, undecanol, dodecanol, tridecanol and the like. Alcohols having a boiling point not higher than 240° C. are preferred because they can be easily recovered by distillation. Of these, methanol is particularly preferred. Of course, mixtures of alcohols, and consequently mixtures of ring-substituted aromatic carboxylic esters, may be used.

In the present invention, olefins having 4–40, preferably 8–30, particularly 12–24 carbon atoms are preferred as the olefin used in the ring alkylation reaction (1). The olefinic double bond may be located either at a position between a terminal carbon atom and its adjacent atom or between interior carbon atoms other than the terminal carbon atoms. Specific examples of the olefin include octene, nonene, decene, undecene, dodecene, tridecene, tetradecene, pentadecene, hexadecene, heptadecene, octadecene, nonadecene, eicosene, docosene, tetracosene and the like. These olefins may be reacted either singly or in any combination thereof.

The ring alkylation reaction (1) may be conducted by any method known per se in the art. For example, a method in which the aromatic carboxylic ester and olefin are reacted for 5–10 hours at 120°–250° C., preferably 180°–230° C. in the presence of an acidic catalyst may be employed. The molar ratio of the olefin used herein to the aromatic carboxylic ester may preferably be 0.1–10, particularly 0.5–3.0. The acidic catalyst includes mineral acids such as sulfuric acid, silica-alumina, and acid clay. However, clay minerals such as montmorillonite and halloysite, and acid clay obtained by treating these minerals with a mineral acid are particularly preferred. When the reaction is conducted in a batch process, the amount of these catalysts may preferably be 1–15 wt. %, particularly 3–10 wt. % based on the total weight of the aromatic carboxylic ester and olefin.

When the alkylation reaction is conducted in a batch process, it is preferable to add the olefin dropwise to a mixture of the aromatic carboxylic ester and the acidic catalyst at the reaction temperature. This method minimizes the extent of self-polymerization of the olefin. In another embodiment, a mixture of the raw materials may be brought into contact with a fixed catalyst bed to react them.

After completion of the alkylation reaction, it is preferable to remove the raw materials remaining unreacted by distillation or solvent extraction in order to collect and reuse them. In the case of extraction, it is suitable to use a lower alcohol such as methanol as a solvent.

The resultant alkyl-ring-substituted aromatic carboxylic ester may be used in process (2) above, also called overbasing herein. Overbasification refers to a process in which the alkyl-ring-substituted aromatic carboxylic ester is converted into a salt with a divalent metal (hereinafter referred to as "neutral salt") and an excess amount of the divalent metal is dispersed as the carbonate in the neutral salt to raise the basicity of the product.

The overbasing step in the present invention is conducted by reacting the alkyl-ring-substituted aromatic carboxylic ester with at least one of an oxide, hydroxide or alcoholate of a divalent metal (hereinafter referred to as "divalent metal base or the like"), and carbon dioxide.

Examples of divalent metals constituting the divalent metal base or the like used herein include alkaline earth metals such as magnesium, calcium, strontium and barium and zinc. Of these, magnesium and calcium are particularly preferred. The divalent metal base or the like may preferably be used in an amount of 1–20 equivalents, particularly 2–10 equivalents based on the alkyl-ring-substituted carboxylic ester.

In the overbasing step, the divalent metal base or the like is added to the alkyl-ring-substituted aromatic carboxylic ester, and in general, they are then reacted for 1 hour or longer at a temperature not lower than 120° C. to form a neutral salt. Any alcohol formed in this reaction may be used as a reaction accelerator or solvent for subsequent reactions.

After forming the neutral salt, carbon dioxide is preferably introduced into the reaction mixture to form the carbonate of the divelent metal. The presence of alcohol is preferred here because it has the effect of facilitating the formation of the divalent metal carbonate. Examples of ways in which alcohol is present during reaction include a method in which the alcohol formed in the system by the decomposition of the ester is used, and a method wherein an alcohol is freshly added to the system. Examples of the alcohol used herein include monohydric lower alcohols such as methanol, ethanol, propanol and butanol; diols such as ethylene glycol, propylene glycol, 1,3-butanediol and 1,4-butanediol; and monoethers of diols, such as ethylene glycol monomethyl ether, ethylene glycol monoethyl ether, diethylene glycol monomethyl ether and diethylene glycol monoethyl ether. As needed, lower aliphatic carboxylic acids such as formic acid, acetic acid, propionic acid and butyric acid may be further used in combination with these alcohols. The alcohol may preferably be used in an amount of 1–60 equivalents, particularly 1–30 equivalents based on the alkyl-ring-substituted carboxylic ester. The alphatic carboxylic acid may proferably be used in an amount of 0.01–0.5 equivalents based on the alkyl ring-substituted carboxylic ester. The overbase reaction may be conducted in the presence of a suitable solvent. Examples of useful solvents include aromatic compounds such as benzene, toluene, xylene and chlorobenzen; higher alcohols which are optionally branched such as octanol, 2-ethylhexanol, isononanol, isodecanol, isoundecanol, isododecanol and isotridecanol; the olefins useful as alkylating agents for the aromatic carboxylic esters (see above) and lubricating oils obtained by refining crude oil. The alcohols described above useful in forming the divalent metal carbonate may also be present.

The amount of carbon dioxide reacted may preferably be about 0.5–0.9, particularly 0.7–0.9 equivalents per equivalent of divalent metal base or the like which is present in excess amount after its neutral salt formation. If the amount of the carbon dioxide is less than 0.5 equivalent, the divalent metal base or the like remains unreacted, so that the amount of solids increases. If carbon dioxide is reacted in an amount exceeding 0.9 equivalents, the divalent metal carbonate formed precipitate, and the amount of solids increases. It may thus be inconvenient in some cases to use carbon dioxide in amounts outside the above range.

While forming a neutral salt, carbon dioxide may be reacted with the neutral salt at the same time. In such a overbasing, however, it is preferable to conduct the reaction at a temperature of 120° C. or higher. It is hence necessary to conduct the reaction under pressure when those materials having a boiling point lower than the reaction temperature are used as the alcohol and/or solvent.

When the alkyl-ring-substituted aromatic carboxylic ester is overbased, at least one of a higher aliphatic carboxylic acid, or an alkylaromatic sulfonic acid and/or a divalent metal salt thereof may be added to the reaction. Examples of the higher aliphatic carboxylic acids include linear or branched carboxylic acids having 12–80 carbon atoms. These compounds are added for the purpose of improving the heat resistance of the resulting lubricating oil additive. The alkylaromatic sulfonic acid preferably contains at least one alkyl chain having 12–80 carbon atoms. Petroleum sulfonates produced from petroleum may be used as the divalent metal salt of the alkylaromatic sulfonic acid.

After overbase reaction, water, alcohols and/or solvent are recovered by distillation. Thereafter, solids may be removed by filtration or centrifugation if necessary to provide the invention lubricating oil additive composition. Where centrifugation is conducted, it is preferably conducted before any accelerator and/or the solvent are distilled off.

A lubricating oil composition according to the present invention is obtained by adding 0.5–40 wt. % of the lubricating oil additive described above to a lubricating base oil comprising a natural oil and/or a synthetic oil. Useful examples of the natural oil include animal oils, vegetable oils and mineral oils. Preferable examples thereof include paraffinic and naphthenic lubricating oils and mixtures thereof. Examples of the synthetic oils include lubricating oils composed of esters of monocarboxylic or polycarboxylic acids having 4–18 carbon atoms, for example, monoester, diester and hindered ester lubricating oils composed of succinic acid, fumaric acid, maleic acid, glutaric acid, adipic acid, sebacic acid, citric acid, tartaric acid, phthalic acid, trimellitic acid, dimer acid or the like and an alcohol, polyol or polyol ether, and hydrocarbon lubricating oils such as alkylbenzenes, alkylnaphthalenes, polyisobutene and polyalpha-olefins. Any commercial motor oil base, etc., may be used. These oils may be used either singly or in any combination thereof. Linear or branched alcohols having 8–18 carbon atoms may be added as desired. Such alcohols may preferably be polyols or polyol ethers, and include, for example, neopentyl glycol, trimethylolpropane, pentaerythritol and dipentaerythritol.

Conventionally-known additives such as metal detergents like phenates, sulfonates, naphthenates and salicylates; zinc dialkyldithiophosphate; zinc dialkylaryldithiophosphate; alkenyl- or alkylsuccinimide and benzylamine type ashless detergent-dispersants; antioxidants; rust preventives; oiliness improvers; viscosity index improvers; and pour point depressants can suitably be added to the lubricating oil compositions according to the present invention, as desired.

The present invention will hereinafter be described in more detail by the following examples. However, it should be borne in mind that this invention is not limited to or by these examples.

EXAMPLE 1

(1) In a 2000-ml flask, were weighed out 760.5 g (5 moles) of methyl salicylate and 108.0 g of acid clay, and the contents were heated to 190° C. To the resulting mixture, 590 g (2.5 moles) of alpha-olefin having 18 carbon atoms were added dropwise over 4 hours. Then, the contents were heated over 1 hour to 220° C. to react them for 2 hours. After the reaction mixture was cooled down to 80° C., the acid clay was removed by filtration. A 1200-g portion of the filtrate was transferred to a 20001-ml flask to distill off unreacted methyl salicylate and alpha-olefin under reduced pressure. The final distillation conditions were 210° C./5 mmHg.

The thus-obtained pale yellow liquid had a saponification value of 114.1 mg KOH/G.

(2) In a 2000-ml flask, were weighed out 491.8 g (1 mole) of the alkylsalicylate obtained in the step (1), 50.0 g of 150 neutral oil (Super Oil A, Nippon Oil Co., Ltd.) and 129.9 g (1.75 moles) of calcium hydroxide, and the contents were heated to 155° C. In the course of the heating, 94 g of ethylene glycol were added. After the contents were reacted for 1 hour at 155° C., 32 liters (at 25° C.) of carbon dioxide were blown into the reaction mixture. While raising the temperature of the contents to 190° C., the pressure in the flask was gradually reduced, thereby obtaining 683.0 g of a viscous brown liquid in the flask. Solids were removed by filtration to obtain a transparent brown liquid.

This product had a base number of 281 mg KOH/G as measured in accordance with JIS K 2501, a method making use of perchloric acid.

EXAMPLE 2

(1) In a 2000-ml flask, were weighed out 760.5 g (5 moles) of methyl salicylate and 100 g of acid clay, and the contents were heated to 190° C. To the resulting mixture, 490 g (2.5 moles) of alpha-olefin having 14 carbon atoms were added dropwise over 3 hours. Then, the contents were heated over 2 hours to 210° C. to react them for 4 hours at 210° C. After the reaction mixture was cooled down to 80° C., acid clay was removed by filtration. A 1200-g portion of the filtrate was transferred to a 2000-ml flask to distill it under reduced pressure. The distillation was conducted under the same conditions as in the step (1) of Example 1. The thus-obtained pale yellow liquid had a saponification value of 137.8 mg KOH/G.

(2) In a 2000-ml flask, were weighed out 285.2 g (0.7 mole) of the methyl alkylsalicylate obtained in the step (1), 53.5 g of a mixture of fatty acids having respectively 14, 16 and 18 carbon atoms (Lunac S30, product of Kao Corporation), 30.0 g (0.1 mole) of branched dodecylbenzenesulfonic acid, 50.0 g of 150 neutral oil and 129.9 g (1.75 moles) of calcium hydroxide, and the contents were heated to 158° C. over 1 hour. In the course of the heating, 93.0 g of ethylene glycol were added. After the contents were stirred for 2 hours at 158° C., 31 liters of carbon dioxide were blown into the liquid reaction mixture. The same procedure as in the step (2) of Example 1 was hereinafter followed. The product thus obtained had a base number of 342.0 mg KOH/G.

EXAMPLE 3

In a 3000-ml flask, were weighed out 491.7 g (1 mole) of the alkylsalicylate obtained in the step (1) of Example 1, 50 g of 150 neutral oil, 550 g of xylene and 185 g (2.5 moles) of calcium hydroxide, and the contents were refluxed for 1 hour. The temperature of the contents was then lowered to 35° C., and 320 g of methanol were added thereto. After 45 liters of carbon dioxide were introduced into the reaction mixture, xylene and methanol were distilled off. Solids were removed by filtration to obtain a transparent brown viscous liquid. This product had a base number of 335 mg KOH/G.

EXAMPLE 4

(1) In a 2000-ml flask, 350 g (2.2 moles) of methyl salicylate and 125 g of acid clay were placed, and heated to 180° C. To the resulting mixture, 1120 g (5.7 moles) of alpha olefin having 14 carbon atoms were added dropwise over 5 hours, during which time the temperature was raised to 210° C. After completion of the addition, reaction was allowed to proceed for a further 5 hours at the same temperature. The acid clay was centrifugally removed to obtain a pale yellow liquid. The thus-obtained product had a saponification value of 70.3 mg KOH/g.

(2) In a 1000-ml flask were placed 203.7 g (0.21 moles) of methyl alkylsalicylate , 60 g of alpha olefin having 14 carbon atoms, 20 g of 150 neutral oil, 24.1 g of an aliphatic acid (Lunac S30, product of Kao Corporation, which is a mixture of aliphatic acids having 14, 15 and 16 carbon atoms), 4.0 g of water and 33.6 g (0.45 moles) of calcium hydroxide, and heated 155° C. In the course of the heating, 22.3 g of ethylene glycol were added and allowed to react at 155° C. for 2 hours. 9.5 liters of carbon dioxide were blown into the reaction mixture over 1.5 hours. While raising the temperature of the contents to 210° C., the pressure in the flask was gradually reduced, thereby obtaining a viscous brown liquid in the flask. Solids were removed by filtration to obtain a transparent brown liquid. This product had a base number of 238 mg KOH/g as measured in accordance with JIS K2501, a method making use of perchloric acid.

The lubricating oil additives obtained in Examples 1–4 exhibited properties as shown in the following Table 1.

TABLE 1

| | Na (ppm) | Base number (mg KOH/g) |
|---|---|---|
| Ex. 1 | <10 | 281 |
| Ex. 2 | <10 | 342 |
| Ex. 3 | <10 | 335 |
| Ex. 4 | <10 | 238 |
| Comp.* Ex. 1 | 220 | 169 |

*Salicylate produced by Royal Dutch Shell Company.

EXAMPLE 5

Using the lubricating oil additives obtained in Examples 1–4 and a commercially-available lubricating oil additive (salicylate), lubricating oil compositions were obtained in accordance with the following formulation.

FORMULATION

1 Lubricating oil additive (adjusted so as to have a base number of 11.0 mg KOH/G with proper amounts of the inventive additive and comparative additive*[1])

2 Zinc dialkyldithiophosphate*[2] 0.5 (wt. %)

3 Succinimide*[3] 2.0

4 Lubricating base oil*[4]

*[1]: Salicylate (product of Royal Dutch Shell Oil Co.)

*[2]OLOA 269R (product of Olonite Japan K.K.)

*[3]OLOA 373 (product of Olonite Japan K.K.)

*[4]SAE30 (product of Nippon Oil Co., Ltd.)

Using the above-described lubricating oil compositions, the following tests were conducted. The results thereof are shown in Tables 2–5.

(Water Separating Property)

Ninety-five grams of an oil sample and 4.5 g of water were placed in a pressure bottle to stir the mixture at 93° C. and 5 rpm. After 24 hours, the whole amount of the mixture was transferred to a centrifugal precipitation tube to centrifuge it for 20 minutes at 1500 rpm. The amount of water separated and the retention of base number of the oil were determined. The results are shown in Table 2.

TABLE 2

| | Additive | Water separated (ml) | Retention of base number (%) |
|---|---|---|---|
| Inventive composition | Example 1 | 4.0 | 98.8 |
| | Example 2 | 3.6 | 98.2 |
| | Example 3 | 3.8 | 98.0 |
| | Example 4 | 3.8 | 98.5 |
| Comparative composition | Marketing product | 3.0 | 96.9 |

(Oxidation Stability Test)

The test was conducted in accordance with "Test for Oxidation Stability of Lubricating Oil", JIS K 2514. The results after 48 hours are shown in Table 3.

TABLE 3

| | Additive | Retention of base number (%) | Increase in acid number | Viscosity ratio |
|---|---|---|---|---|
| Inventive composition | Example 1 | 60.6 | 1.6 | 1.06 |
| | Example 2 | 58.0 | 1.2 | 1.04 |
| | Example 3 | 55.2 | 1.1 | 1.05 |
| | Example 4 | 58.8 | 0.8 | 1.02 |
| Comparative composition | Marketing product | 52.6 | 0.6 | 1.10 |

(panel coking test)

An oil sample was splashed on an aluminum panel heated to an elevated temperature under the following conditions. After the test, the weight of carbonaceous material accumulated on the alminum panel was measured to evaluate the oil sample's susceptibility to carbonization. The results are shown in Table 4.

Amount of oil: 250 ml

Temperature of oil: 100 ° C.

Splash time: 15 seconds

Suspending time: 45 seconds

Testing time: 3 hours

TABLE 4

| | Additive | Temperature of panel (°C.) 320 | 330 |
|---|---|---|---|
| Inventive composition | Example 1 | 5.8 mg | 28.5 mg |
| | Example 2 | 0.5 mg | 8.2 mg |
| | Example 3 | 8.2 mg | 27.0 mg |
| | Example 4 | 1.6 mg | 14.6 mg |
| Comparative composition | Marketing product | 17.5 mg | 55.8 mg |

(Diesel Engine Test)

Evaluated in accordance with "Testing Method for Cleanability of Diesel Engine Lubricating Oil" (JASO M336) prescribed by Society of Automotive Technique. The results are shown in Table 5.

TABLE 5

| | Inventive Composition Example 2 | Comparative Composition Marketing Product |
|---|---|---|
| TGF(%) | 45.8 | 60.5 |
| Score of underside accumulation | 7.5 | 6.9 |
| Weight loss (mg) | | |
| Top ring | 13.8 | 21.9 |
| Second ring | 7.0 | 11.2 |
| Oil ring | 4.6 | 9.1 |

While the present invention has been described in terms of its specific embodiments, certain modifications and equivalents will be apparent to those skilled in the art and are intended to be included within the scope of the present invention, which is to be limited only by scope of the appended claims.

What is claimed as new and desired to be secured by Letters Patent of the United States is:

1. A lubricating oil additive composition obtained by a process comprising (1) subjecting a salicylic ester to ring alkylation with a $C_{12}$–$C_{24}$ olefin, (2) reacting at least one of an oxide, hydroxide or alcoholate of calcium, and carbon dioxide with the alkyl-ring-substituted salicylic ester obtained in (1) in the presence of an alcohol selected from the group consisting of methanol, ethanol, propanol, butanol, ethylene glycol, propylene glycol, 1,3-butanediol, 1,4-butanediol, ethylene glycol monomethylether, ethylene glycol monoethylether, diethylene glycol monomethylether and diethylene glycol monoethylether, and an olefin and (3) removing any water and alcohol formed during, or added to, the reaction in (2) from the reaction mixture.

2. The lubricating oil additive composition according to claim 1, wherein the reaction of said at least one oxide, hydroxide or alcoholate of calcium and said carbon dioxide with the alkyl-ring-substituted salicylic ester is conducted in the presence of an alcohol and an olefin and at least one compound selected from the group consisting of a higher aliphatic carboxylic acid, an alkylaromatic sulfonic acid and a divalent metal salt thereof.

3. The lubricating oil additive composition according to claim 1, wherein said ring alkylation is conducted in the presence of an acid catalyst.

4. The lubricating oil additive composition according to claim 1, wherein said ring alkylation is conducted by adding the olefin dropwise to said saliclic ester.

5. The lubricating oil additive composition as claimed in claim 1, wherein the alkyl-ring-substituted salicylic ester produced in step (1) is subjected to distillation under reduced pressure to distill off unreacted salicylic ester and olefin.

6. The lubricating oil additive composition as claimed in claim 1, wherein step (1) is accomplished in the presence of an acidic catalyst selected from the group consisting of montmorillonite, halloysite, acid clay obtained by treating montmorillonite with a mineral acid and acid clay obtained by treating halloysite with a mineral acid.

7. A lubricating oil additive as claimed in claim 1, wherein said alcohol is ethylene glycol.

8. A process for the preparation of a lubricating oil additive composition, which comprises (1) subjecting a salicylic ester to ring alkylation with a $C_{12}$–$C_{24}$ olefin, (2) reacting at least one of an oxide, hydroxide or alcoholate of calcium, and carbon dioxide with the alkyl-ring-substituted salicylic ester obtained in (1) in the presence of an alcohol selected from the group consisting of methanol, ethanol, propanol, butanol, ethylene glycol, propylene glycol, 1,3-butanediol, 1,4-butanediol, ethylene glycol monomethylether, ethylene glycol monoethylether, diethylene glycol monomethylether and diethylene glycol monoethylether, and (3) removing any water and alcohol formed during or added to the reaction in (2) from the reaction mixture.

9. The process according to claim 8, wherein the reaction of said at least one of an oxide, hydroxide or alcoholate of calcium and said carbon dioxide with the alkyl-ring-substituted salicylic ester is conducted in the presence of an alcohol and an olefin.

10. The process according to claim 9, wherein the reaction of said at least one of an oxide, hydroxide or alcoholate of calcium and said carbon dioxide with the alkyl-ring-substituted salicylic ester is conducted in the presence of an alcohol and an olefin and at least one compound selected from the group consisting of a higher aliphatic carboxylic acid, an alkylaromatic sulfonic acid and a divalent metal salt thereof.

11. The process according to claim 9, wherein said ring alkylation is conducted in the presence of an acid catalyst.

12. The process according to claim 9, wherein said ring alkylation is conducted by adding the olefin dropwise to said salicylic ester in the presence of an alcohol and an olefin.

13. The process as claimed in claim 8, wherein the alkyl-ring-substituted salicylic ester produced in step (1) is subjected to distillation under reduced pressure to distill off unreacted salicylic ester and olefin.

14. The process as claimed in claim 8, wherein step (1) is accomplished in the presence of an acidic catalyst selected from the group consisting of montmorillonite, halloysite, acid clay obtained by treating montmorillonite with a mineral acid and acid clay obtained by treating halloysite with a mineral acid.

15. A lubricating oil composition comprising a lubricating base oil, said base oil comprising a natural oil and/or a synthetic oil, and a lubricating oil additive composition, said lubricating oil additive composition obtained by a process comprising (1) subjecting a salicylic ester to ring alkylation with a $C_{12}$–$C_{24}$ olefin, (2) reacting at least one of an oxide, hydroxide or alcoholate of calcium, and carbon dioxide with the alkyl-ring-substituted salicylic ester obtained in (1) in the presence of an alcohol selected from the group consisting of methanol, ethanol, propanol, butanol, ethylene glycol, propylene glycol, 1,3-butanediol, 1,4-butanediol, ethylene glycol monomethylether, ethylene glycol monoethylether, diethylene glycol monomethylether and diethylene glycol monoethylether, and an olefin and (3) removing any water and alcohol formed during, or added to, the reaction in (2) from the reaction mixture.

16. The lubricating oil composition according to claim 15, wherein the lubricating oil additive composition is present in an amount of 0.5–40 wt. % based on the total wt. % of the composition.

17. The lubricating oil composition as claimed in claim 15, wherein the alkyl-ring-substituted salicylic ester produced in step (1) is subjected to distillation under reduced pressure to distill off unreacted salicylic ester and olefin.

18. The lubricating oil composition as claimed in claim 15, wherein step (1) is accomplished in the presence of an acidic catalyst selected from the group consisting of montmorillonite, halloysite, acid clay obtained by treating montmorillonite with a mineral acid and acid clay obtained by treating halloysite with a mineral acid.

* * * * *